US005571459A

United States Patent [19]

Thomas et al.

[11] Patent Number: 5,571,459

[45] Date of Patent: Nov. 5, 1996

[54] MICROEMULSION ALL PURPOSE LIQUID CLEANING COMPOSITIONS

[75] Inventors: Barbara Thomas, Princeton; Steven Adamy, Hamilton, both of N.J.; Guy Broze, Grace-Hollogne, Belgium; Ammanuel Mehreteab, Piscataway; Frank Bala, Jr., Middlesex, both of N.J.; Myriam Mondin, Seraing; Myriam Loth, Saint-Nicolas, both of Belgium

[73] Assignee: Colgate-Palmolive Co., Piscataway, N.J.

[21] Appl. No.: 350,576

[22] Filed: Dec. 7, 1994

Related U.S. Application Data

[63] Continuation-in-part of Ser. No. 192,902, Feb. 7, 1994, abandoned.

[51] Int. Cl.[6] ..... C11D 1/722; C11D 1/83

[52] U.S. Cl. ..... 510/365; 510/417

[58] Field of Search ..... 252/174.22, 174.21, 252/550, 551, 162, 170, 173, DIG. 1

[56] References Cited

U.S. PATENT DOCUMENTS 5,108,643 4/1992 Loth et al. ..... 252/174.11

5,403,509 4/1995 Pujol et al. ..... 252/174.22

FOREIGN PATENT DOCUMENTS 0387647 9/1990 European Pat. Off. .

1453385 10/1976 United Kingdom .

*Primary Examiner*—Paul Lieberman

*Assistant Examiner*—Lorna M. Douyon

*Attorney, Agent, or Firm*—Richard E. Nanfeldt; James Serafino

[57] ABSTRACT

An improvement is described in microemulsion compositions which are more friendly to the environment and contain an anionic sulfate surfactant, an esterfied polyethoxyether surfactant, a cosurfactant, at least one hydrocarbon, and water which can comprise the use of a water-insoluble odoriferous perfume as the essential hydrocarbon in a proportion sufficient to form a dilute o/w microemulsion composition preferably containing, by weight, 0.1% to 8% of an anionic sulfate surfactant, 1% to 50% of a cosurfactant, 1% to 20% of an ethoxylated glycerol type compound, 0.4% to 20% of perfume and the balance being water.

5 Claims, No Drawings

MICROEMULSION ALL PURPOSE LIQUID CLEANING COMPOSITIONS

RELATED APPLICATION

This application is a continuation in part application of U.S. Ser. No. 08/192,902, filed Feb. 7, 1994, now abandoned.

FIELD OF THE INVENTION

This invention relates to an improved all-purpose liquid cleaner in the form of a microemulsion designed in particular for cleaning hard surfaces and which is effective in removing grease soil and/or bath soil and in leaving unrinsed surfaces with a shiny appearance.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations off inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surface or all-purpose liquid detergent compositions where product homogeneity and clarity are important considerations involves the formation of oil-in-water (o/w) microemulsions which contain One or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of about 25 to about 800Å in a continuous aqueous phase. In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616-Herbots et al; European Patent Application EP 0160762-Johnston et al; and U.S. Pat. No. 4,561,991-Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to about 18% by weight of the aqueous phase), the presence of such high quantities of grease-removal solvent tend to reduce the total amount of greasy or oily soils which can be taken up by and into the microemulsion without causing phase separation. The following representative prior art patents also relate to liquid detergent cleaning compositions in the form of o/w microemulsions: U.S. Pat. Nos. 4,472,291-Rosario; 4,540,448-Gauteer et al; 3,723,330-Sheflin; etc.

Liquid detergent compositions which include terpenes, such as d-limonene, or other grease-removal solvents, although not disclosed to be in the form of o/w microemulsions, are the subject matter of the following representative patent documents: European Patent Application 0080749; British Patent Specification 1,603,047; and U.S. Pat. Nos. 4,414,128; and 4,540,505. For example, U.S. Pat. No. 4,414,128 broadly discloses an aqueous liquid detergent composition characterized by, by weight:

(a) from about 1% to about 20% of a synthetic anionic, nonionic, amphoteric or zwitterionic surfactant or mixture thereof;

(b) from about 0.5% to about 10% of a mono- or sesquiterpene or mixture thereof, at a weight ratio of (a):(b) lying in the range of 5:1 to 1:3; and (c) from about 0.5% about 1.0% of a polar solvent having a solubility in water at 15° C. in the range of from about 0.2% to about 10%. Other ingredients present in the formulations disclosed in this patent include from about 0.05% to about 2% by weight of an alkali metal, ammonium or alkanolammonium soap of a $C_{13}$–$C_{24}$ fatty acid; a calcium sequestrant from about 0.5% to about 13% by weight; non-aqueous solvent, e.g., alcohols and glycol ethers, up to about 10% by weight; and hydrotrppes, e.g., urea, ethanolamines, salts of lower alkylaryl sulfonates, up to about 10% by weight. All of the formulations shown in the Examples of this patent include relatively large amounts of detergent builder salts which are detrimental to surface shine.

It is more difficult to form a stable microemulsion, if the formulation contains grease-removal assisting magnesium compounds or builder salts, such as alkali metal polyphosphates, alkali metal carbonates, nitrilotriacetic acid salts, and so on.

U.S. Pat. No. 5,082,584 discloses a microemulsion composition having an anionic surfactant, a cosurfactant, nonionic surfactant, perfume and water; however, these compositions do not possess the reduced ecotoxicity and the improved interfacial tension properties as exhibited by the compositions of the instant invention.

British Patent No. 1,453,385 discloses polyesterified nonionic surfactants similar to the polyesterified nonionic surfactants of the instant invention. However, these nonionic surfactants of British Patent 1,453,385 do not disclose the formula (II) portion of the instant composition. Additionally, the formulated compositions of British Patent 1,453,385 fail to disclose the critical limitations of the instant invention.

U.S. Pat. No. 3,776,857 discloses the use of long chain fatty acid esters of ethylene oxide adducts of aliphatic polyhydric alcohols as surfactants for use in agricultural compositions.

A number of patents teach esterified ethoxylated glycerol compounds for various applications. These patents are Great Britain 1,453,385; Japan 59-1600 and Japan 58-206693 and European Patent Application 0586,323Al. These publications fail to appreciate that a mixture of esterified ethoxylated glycerol and nonesterified ethoxylated glycerol, when used in a hard surface cleaning composition, functions as a grease release agent.

SUMMARY OF THE INVENTION

The present invention provides an improved, clear, liquid cleaning composition having improved interfacial tension which improves cleaning hard surfaces in the form of a microemulsion which is suitable for cleaning hard surfaces such as plastic, vitreous and metal surfaces having a shiny finish. More particularly, the improved cleaning compositions exhibit good grease soil removal properties due to the improved interfacial tensions, when used in undiluted (neat) form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant compositions exhibit a grease release effect in that the instant compositions impede or decrease the anchoring of greasy soil on surfaces that have been cleaned with the instant compositions as compared to surfaces cleaned with a commercial microemulsion composition which means that the soiled surface is easier to clean the next time. Surprisingly, these desirable results are accomplished even in the absence of polyphosphate or other inorganic or organic detergent builder salts and also in the complete absence or substantially complete absence of grease-removal solvent.

The instant compositions are more friendly for the environment due to the low ecotoxicity of the ethoxylated glycerol type compounds used in the instant compositions.

In one aspect, the invention generally provides a stable, clear all-purpose, hard surface cleaning composition especially effective in the removal of oily and greasy soil, which is in the form of a substantially dilute oil-in-water microemulsion having an aqueous phase and an oil phase. The dilute o/w microemulsion includes, on a weight basis:

from about 0.1% to 8% by weight of an anionic sulfate surfactant;

from 1 to about 50% of a cosurfactant having either limited ability or substantially no ability to dissolve oily or greasy soil;

about 1.0% to about 20% of a mixture of a partially esterified ethoxylated polyhydric alcohol, a fully esterified ethoxylated polyhydric alcohol, and a nonesterified ethoxylated polyhydric alcohol (said mixture being hereinafter referred to as an ethoxylated glycerol type compound);

0 to about 15% of magnesium sulfate heptahydrate;

about 0.4 to about 20.0% of at least one perfume or water insoluble hydrocarbon and mixtures thereof and about 10 to about 85% of water, said proportions being based upon the total weight of the composition. The dispersed oil phase of the o/w microemulsion is composed essentially of a water-immiscible or hardly water-soluble perfume.

Quite surprisingly although the perfume is not, per se, a solvent for greasy or oily soil,—even though some perfumes may, in fact, contain as much as about 80% of terpenes which are known as good grease solvents—the inventive compositions in dilute form have the capacity to solubilize up to about 10 times or more of the weight of the perfume of oily and greasy soil, which is removed or loosened from the hard surface by virtue of the action of the anionic and nonionic surfactants, said soil being taken up into the oil phase of the o/w microemulsion.

In the second aspect, the invention generally provides highly concentrated microemulsion compositions in the form of either an oil-in-water (o/w) microemulsion or a water-in-oil (w/o) microemulsion which when diluted with additional water before use can form dilute o/w microemulsion compositions. Broadly, the concentrated microemulsion compositions contain, by weight, 0.1% to 8% of an anionic sulfate surfactant, 0 to 16 % of a nonionic surfactant, 1% to 20% of an ethoxylated glycerol type compound, 0.4% to 20% of at least one perfume or water insoluble hydrocarbon having about 6 to 18 carbon atoms and mixtures thereof, 1 to 50% of a cosurfactant, and 20% to 97% of water. The concentrated microemulsions can be diluted with up to 20 times their weight of water to form o/w microemulsions.

DETAILED DESCRIPTION OF THE INVENTION

The present invention relates to a stable microemulsion composition approximately by weight; 0.1% to 8% of an anionic sulfate surfactant, 1% to 50% of a cosurfactant, 1.0% to 20% of a solubilizing agent which is a partially esterified ethoxylated glycerol type compound, 0.4% to 20% of at least one water insoluble hydrocarbon or a perfume and mixtures thereof, and the balance being water.

The detergent compositions of the present invention are in the form of an oil-in-water microemulsion with the essential ingredients being water, cosurfactant, artionic surfactant, a solubilizing agent which is a partially esterified ethoxylated glycerol and hydrocarbon or perfume and mixtures thereof.

According to the present invention the role of the hydrocarbon can be provided by a water insoluble perfume. As used herein and in the appended claims the term "perfume" is used in its ordinary sense to refer to and include any water insoluble fragrant substance or mixture of substances, including natural (i.e., obtained by extraction of flower, herb, blossom or plant) and artificial (i.e., mixture of natural oils or oil constituents and synthetically produced substances) odoriferous substances. Typically, perfumes are complex mixtures of blends of various organic compounds such as alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc.

The hydrocarbon such as a perfume is present in the dilute o/w microemulsion in an amount of from about 0.4% to about 20% by weight, preferably from about 0.4% to about 15% by weight, especially preferably from about 0.5% to about 10% by weight percent. If the amount of hydrocarbon (perfume) is less than about 0.4% by weight it becomes difficult to form the o/w microemulsion. If the hydrocarbon (perfume) is added in amounts more than about 10% by weight, the cost is increased without any additional cleaning benefit and, in fact, with some diminishing of cleaning performance insofar as the total amount of greasy or oily soil which can be taken up in the oil phase of the microemulsion will decrease proportionately.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which include less than about 20%, usually less than about 30%, of such terpene solvents.

Thus, merely as a practical matter, based on economic consideration, the dilute o/w microemulsion detergent cleaning compositions of the present invention may often include as much as about 0.2% to about 7% by weight, based on the total composition, of terpene solvents introduced thereunto via the perfume component. However, even when the amount of terpene solvent in the cleaning formulation is less than 1.5% by weight, such as up to about 0.6% by weight or 0.4% by weight or less, satisfactory grease removal and oil removal capacity is provided by the inventive diluted o/w microemulsions.

Thus, for a typical formulation of a diluted o/w microemulsion according to this invention a 20 milliliter sample of o/w microemulsion containing 1% by weight of perfume will be able to solubilize, for example, up to about 2 to 3 ml of greasy and/or oily soil, while retaining its form as a microemulsion, regardless of whether the perfume contains terpene solvent. In other words, it is an essential feature of the compositions of this invention that grease removal is a function of the result of the microemulsion, per se, and not of the presence or absence in the microemulsion of a "greasy soil removal" type of solvent.

In place of or in partial place of the perfume one can employ a water insoluble paraffin or isoparaffin having about 6 to about 18 carbon at a concentration of about 0.4 to about 20 wt. percent, more preferably 0.4 to 15 wt. percent. The paraffin or isoparaffin has about 8 to about 20 carbon atoms such as dodecane or octane. Another suitable hydrocarbon is a complex oil-triolein.

The anionic surfactant present in the o/w microemulsions is an alkaline earth metal salt of an alkyl sulfate. Examples of satisfactory anionic sulfate surfactants are the $C_8$–$C_{18}$ alkyl sulfate metal salts, wherein the metal salt is a solubilizing cation which is a sodium, ammonium, or magnesium cation. The alkyl sulfates may be obtained by sulfating the alcohols obtained by reducing glycerides of coconut oil or tallow or mixtures thereof and neutralizing the resultant product.

The $C_8$–$C_{12}$ alkylphenyl ether polyethenoxy sulfates containing from 2 to 6 moles of ethylene oxide in the molecule also are suitable for use in the inventive compositions.

Generally, the proportion of the nonsoap-anionic surfactant will be in the range of 0.1% to 20.0%, preferably from 1% to 7%, by weight of the dilute o/w microemulsion composition.

The instant composition contains a compound which is a mixture of a fully esterified ethoxylated polyhydric alcohol, a partially esterified ethoxylated polyhydric alcohol and a nonesterified ethoxylated polyhydric alcohol, wherein the preferred polyhydric alcohol is glycerol, and the compound is Formula (I)

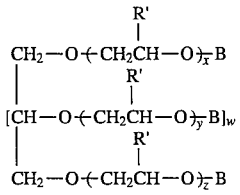

Formula (II)

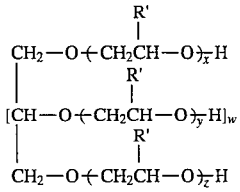

wherein w equals one to four, most preferably one. B is selected from the group consisting of hydrogen or a group represented by:

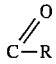

wherein R is selected from the group consisting of alkyl group having about 6 to 22 carbon atoms, more preferably about 11 to about 15 carbon atoms and alkenyl groups having about 6 to 22 carbon atoms, more preferably about 11 to 15 carbon atoms, wherein a hydrogenated tallow alkyl chain or a coco alkyl chain is most preferred, wherein at least one of the B groups is represented by said

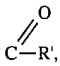

and R' is selected from the group consisting of hydrogen and methyl groups; x, y and z have a value between 0 and 60, more preferably 0 to 40, provided that (x+y+z) equals about 2 to about 100, preferably 4 to about 24 and most preferably about 4 to 19, wherein in Formula (I) the ratio of monoester/diester/triester is 40 to 90/5 to 35/1 to 20, more preferably 50 to 90/9 to 32/1 to 12, wherein the ratio of Formula (I) to Formula (II) is a value between about 3 to about 0.02, preferably 3 to about 0.1, most preferably about 1.5 to about 0.2, wherein it is most preferred that there is more of Formula (II) than Formula (I) in the mixture that forms the compound.

The ethoxylated glycerol type compound used in the instant composition is manufactured by the Kao Corporation and sold under the trade name Levenol such as Levenol F-200 which has an average EO of 6 and a molar ratio of coco fatty acid to glycerol of 0.55 or Levenol V501/2 which has an average EO of 17 and a molar ratio of tallow fatty acid to glycerol of 1.0. It is preferred that the molar ratio of the fatty acid to glycerol is less than about 1.7, more preferably less than about 1.5 and most preferably less than about 1.0. The ethoxylated glycerol type compound has a molecular weight of about 400 to about 1600, and a pH (50 grams/liter of water) of about 5–7. The Levenol compounds are substantially non irritant to human skin and have a primary biodegradabillity higher than 90% as measured by the Wickbold method Bias-7d.

Two examples of the Levenol compounds are Levenol V-501/2 which has 17 ethoxylated groups and is derived from tallow fatty acid with a fatty acid to glycerol ratio of 1.0 and a molecular weight of about 1465 and Levenol F-200 has 6 ethoxylated groups and is derived from coco fatty acid with a fatty acid to glycerol ratio of 0.55. Both Levenol F-200 and Levenol V-501/2 are composed of a mixture of Formula (I) and Formula (II). The Levenol compounds has ecoxicity values of algae growth inhibition >100 mg/liter; acute toxicity for Daphniae >100 mg/liter and acute fish toxicity>100 mg/liter. The Levenol compounds have a ready biodegradability higher titian 60% which is the minimum required value according to OECD 301B measurement to be acceptably biodegradable.

Polyesterified nonionic compounds also useful in the instant compositions are Crovol PK-40 and Crovol PK-70 manufactured by Croda GMBH of the Netherlands. Crovol PK-40 is a polyoxyethylene (12) Palm Kernel Glyceride which has 12 EO groups. Crovol PK-70 which is prefered is a polyoxyethylene (45) Palm Kernel Glyceride have 45 EO groups.

In the dilute o/w microemulsion compositions or liquid crystal compositions the ethoxylated glycerol type compounds or the polyesterified nonionic compounds will be present in admixture with the anionic detergent. The proportion of the ethoxylated glycerol type compound or the polyesterified nonionic solubilizing agent based upon the weight of the liquid crystal composition or the final dilute o/w microemulsion composition will be 0.1% to 20%, more preferably 0.5% to 10%, most preferably about 0.5% to 6% by weight.

Furthermore, in the more preferred compositions the weight ratio of nonscap anionic detergent to the ethoxylated glycerol type compound will be in the range of 3:1 to 1:3 with especially good results being obtained at a weight ratio of 2:1.

Highly suitable cosurfactants used in the instant microemulsion compositions over temperature ranges extending from 5° C. to 43° C. are selected from the group consisting of water soluble $C_3$–$C_7$, preferably $C_3$–$C_5$ alkanols, cycloalkanols and isoalkanols, polypropylene glycol of the formula $HO(CH_3CHCH_2O)_nH$ wherein n is a number from 2 to 18 and monoalkyl ethers and esters of ethylene glycol and propylene glycol having the structural formulas $R(X)_nOH$ and $R_1(X)_nOH$ wherein R is a $C_1$–$C_6$ alkyl group, $R_1$ is a $C_2$–$C_4$ acyl group, X is $(OCH_2CH_2)$ or $(OCH_2(CH_3)CH)$ and n is a number from 1 to 4 and mixtures thereof.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (available as Butyl Cellosolve from Union Carbide), diethylene glycol monobutyl ether (Butyl Carbitol), ethylene glycol monohexyl ether (Hexyl Cellosolve), diethylene glycol monohexyl ether (Hexyl Carbitol), triethylene glycol monobutyl ether, mono, di, tri propylene glycol monobutyl ether, tetraethylene glycol monobutyl ether, propylene glycol tertiary butyl ether, ethylene glycol monoacetate and dipropylene glycol proprionate.

While all of the aforementioned glycol ether compounds provide the described stability, the most preferred cosurfactant compounds on the basis of cost and cosmetic appearance (particularly odor), are diethylene glycol monobutyl ether or diethylene glycol monohexyl ether.

The amount of cosurfactant required to stabilize the microemulsion compositions will, of course, depend on such factors as the surface tension characteristics of the cosurfactant, the type and amounts of the primary surfactants and perfumes, and the type and amounts of any other additional ingredients which may be present in the composition and which have an influence on the thermodynamic factors enumerated above. Generally, amounts of cosurfactant in the range of from 1% to 50%, preferably from about 2% to 15%, especially preferably from about 2% to 10%, by weight provide stable dilute o/w microemulsions for the above-described levels of primary surfactants and perfume and any other additional ingredients as described below.

The final essential ingredient in the inventive microemulsion compositions having improved interfacial tension properties is water. The proportion of water in the dilute o/w microemulsion compositions generally is in the range of 20% to 97%, preferably 70% to 97% by weight of the usual diluted o/w microemulsion composition.

As believed to have been made clear from the foregoing description, the dilute o/w microemulsion liquid all-purpose cleaning compositions of this invention are especially effective when used as is, that is, without further dilution in water, since the properties of the composition as an o/w microemulsion are best manifested in the neat (undiluted) form. However, at the same time it should be understood that depending on the levels of surfactants, cosurfactants, perfume and other ingredients, some degree of dilution without disrupting the microemulsion, per se, is possible. For example, at the preferred low levels of active surfactant compounds, dilutions up to about 50% will generally be well tolerated without causing phase separation, that is, the microemulsion state will be maintained.

The present invention also relates to a stable concentrated microemulsion composition comprising approximately by weight:

(a) 0.1 to 8% of an anionic sulfate surfactant;

(b) 1 to 20% of a ethoxylated glycerol type compound;

(c) 1 to 50% of a cosurfactant which is selected from the group consisting of an alkanol, cycloalkanol or isoalkanol having about 3 to about 9 carbon atoms, poly propylene glycols, monoalkyl ethers of ethylene or propylene glycol and esters of ethylene glycol and propylene glycol;

(d) 0.4 to 20% of at least one perfume or water-insoluble hydrocarbon and mixtures thereof; and (e) the balance being water.

Such concentrated microemulsions can be diluted by mixing with up to about 20 times or more, preferably about 4 to about 10 times their weight of water to form o/w microemulsions similar to the diluted microemulsion compositions described above. While the degree of dilution is suitably chosen to yield an o/w microemulsion composition after dilution, it should be recognized that during the course of dilution both microemulsion and non-microemulsion phases may be successively encountered.

In addition to the above-described essential ingredients required for the formation of the microemulsion composition, the compositions of this invention may often and preferably do contain one or more additional ingredients which :serve to improve overall product performance.

One such ingredient is an inorganic or organic salt or oxide of a multivalent metal cation, particularly Mg++ or Al+++. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the pH of the system, the nature of the primary surfactants and cosurfactant, and so on, as well as the availability and cost factors, other suitable polyvalent metal ions include aluminum, copper, nickel, iron, calcium, etc. It should be noted, for example, that with the preferred alkyl sulfate anionic detergent calcium salts will precipitate and should not be used. It has also been found that the aluminum salts work best at pH below 5 or when a low level, for example about 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalent between the anionic surfactant and the multivalent metal cation. For example, for each gram-ion of Mg++ there will be 2 gram moles of anionic surfactant, while for each gram-ion of $Al^{3}$+ there will be 3 gram moles of anionic surfactant. Thus, the proportion of the multivalent salt generally will be selected so that one equivalent of compound will neutralize from 0.1 to 1.5 equivalents, preferably 0.9 to 1.1 equivalents, of the acid form of the anionic detergent. At higher concentrations of anionic detergent, the amount of multivalent salt will be in range of 0.5 to 1 equivalents per equivalent of anionic detergent.

The o/w microemulsion compositions can also include from 0% to,2.5%, preferably from 0.1% to 2.0% by weight of the composition of a $C_8$–$C_{22}$ fatty acid or fatty acid soap as a foam suppressant. The addition of fatty acid or fatty acid soap provides an improvement in the rinseability of the composition whether applied in neat or diluted form. Generally, however, it is necessary to increase the level of cosurfactant to maintain product stability when the fatty acid or soap is present.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains), oleic acid, stearic acid, palmitic acid, eiocosanoic acid, and the like, generally those fatty acids having from 8 to 22 carbon atoms being acceptable. If more than 2.5 wt. % of the fatty is used in the instant compositions, the composition will become unstable at low temperatures as well as having an unobjectionable smell.

The all-purpose liquid cleaning composition of this invention may, if desired, also contain other components either to provide additional effect or to make the product more attractive to the consumer. The following are mentioned by way of example: Colors or dyes in amounts from 0.01 to 0.5% by weight; bactericides in amounts from 0.01 to 1% by weight; preservatives or antioxidizing agents, such as formalin, 5-chloro-2-methyl-4-isothaliazolin-3-one; 2,6-di-tert-butyl-p-cresol, etc., in amounts up to 2% by weight; and pH adjusting agents, such as sulfuric acid or sodium hydroxide, as needed. Furthermore, if opaque compositions are desired, from 0.01 to 4% by weight of an opacifier may be added.

The instant compositions do not contain any alkali metal silicates or alkali metal detergent builder salts such as alkali metal phosphonates, alkali metal carbonates, alkali metal polyphosphates or alkali metal citrates because, if these materials are used in the instant composition, they will make the compositions too caustic arid leave a residue on the surface being cleaned. The instant compositions do not contain any betaine surfactants because if betaine surfactants are used in the instant composition, the foam profile of the instant compositions would be too high. The concentration of the fatty acid used in the instant compositions must be less than 2.5 wt. % because at concentrations higher than 2.5 wt. % of the fatty acid the composition would have an objectionable smell as well. The instant composition does not contain any methanol or ethanol because of their extremely low flash points.

In final form, the all-purpose liquids are clear oil-in-water microemulsions and exhibit stability at reduced and increased temperatures. More specifically, such compositions remain clear and stable in the range of 5° C. to 50° C., especially 10° C. to 43° C. Such compositions exhibit a pH in the acid or neutral range depending on intended end use. The liquids are readily pourable and exhibit a viscosity in the range of 6 to 60 centipoises (cps) as measured at 25° C. with a Brookfield RVT Viscometer using a #1 spindle rotating at 20 RPM. Preferably, the viscosity is maintained in the range of 10 to 40 cps.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable arid provide a better "shine" on cleaned hard surfaces.

When intended for use in the neat form, the liquid compositions can be packaged under pressure in an aerosol container or in a pump-type or trigger-type sprayer for the so-called spray-and-wipe type of application.

Because the compositions as prepared are aqueous liquid formulations and since no particular mixing is required to form the o/w microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The instant microemulsion formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The following examples illustrate liquid cleaning compositions of the described invention. The exemplified compositions are illustrative only and do not limit the scope of the invention. Unless otherwise specified, the proportions in the examples and elsewhere in the specification are by weight percent.

EXAMPLE I

Formula A was prepared by simple liquid mixing procedure and Formula A was compared to a commercial microemulsion (Ajax Frais Microemulsion) sold by Colgate-Palmolive Co.

| | A |
|---|---|
| Levenol V-501/2 | 2.4 |
| Magnesium Lauryl Sulfate | 3.6 |
| Ethylene Glycol Monohexyl Ether | 3.0 |
| Dodecane | 1.0 |
| Deionized Water | Balance |

The cleaning test was performed according to the following procedure:

A mixture of 50% hard tallow and 50% soft tallow dyed with D&C Red #17 was applied to new Formica tiles (15 cm×15 cm) by spraying a chloroform solution with an air brush. A 10% solution of the grease was used. A 0.01% solution of the dye was used. For this test, 1.0 g of each formula was applied to sponges which were previously saturated with tap water and wrung out. The sponges were placed in holders and placed in a sled of a Gardner Abrader apparatus. Each sponge holder contained 270 g of lead shot. The abrader was allowed to operate for the desired number of strokes and the Reflectence (Rd) of the tile was measured. The operation was continued stopping after 1,3, 5, and 10 strokes.

$$\%\ \text{cleaned} = \frac{\text{Reflectance of cleaned tile} - \text{Reflectance of soiled tile}}{\text{Reflectance of unsoiled tile} - \text{Reflectance of soiled tile}} \times 100$$

An average of three readings was used for each value which showed that in the neat application, formula A and commercial Ajax Frais are substantially equal in the removal of the grease.

EXAMPLE II

The following compositions in wt % were prepared by simple liquid mixing procedures

| | A | B | C | Ajax Frais Microemulsion |
|---|---|---|---|---|
| Magnesium Lauryl Sulfate | 2.9 | 2.9 | 2.9 | |
| Levenol V-501/2 | 6.7 | 6.7 | 6.7 | |
| Pentanol | 4.0 | 5.7 | 3.8 | |
| Dodecane | — | 5.0 | 4.3 | |
| Deionized water | Bal. | Bal. | Bal. | |
| pH | 7 | 7 | 7 | |
| Triolein uptake | 1.2 | 4.5 | 3.3 | 0.0 |

In summary, the described invention broadly relates to an improvement in microemulsion compositions containing an anionic sulfate surfactant, an esterified polyethoxyether surfactant, a cosurfactant, at least one hydrocarbon ingredient and water which can comprise the use of a water-insoluble, odoriferous perfume as the essential hydrocarbon ingredient in a proportion sufficient to form a dilute o/w microemulsion composition containing, by weight, 0.1% to 8% of an anionic sulfate surfactant, 1% to 20% of an ethoxylated glycerol type compound such as Levenol F-200 or Levenol V-501/2, 1% to 50% of cosurfactant, 0.4% to 20% of at least one hydrocarbon or perfume and the balance being water.

What is claimed is:

1. A microemulsion composition comprising:

(a) about 1 wt. % to about 20 wt. % of a mixture of

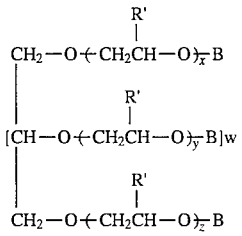

and

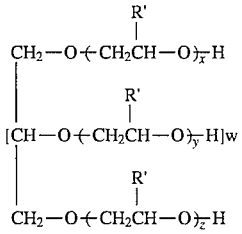

wherein w equals one to four, and B is selected from the group consisting of hydrogen and a group represented by:

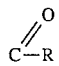

wherein R is selected from the group consisting of alkyl group having about 6 to 22 carbon atoms, and alkenyl groups having about 6 to 22 carbon atoms, wherein at least one of the B groups is represented by said

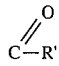

R' is selected from the group consisting of hydrogen and methyl groups; x, y and z have a value between 0 and 60, provided that (x+y+z) equals about 2 to about 100, wherein in Formula (I) the weight ratio of monoester/diester/triester is 40 to 90/5 to 35/1 to 20, wherein the weight ratio of Formula (I) to Formula (II) is a value between about 3 to about 0.02;

(b) about 0.1 wt. % to about 8 wt. % of an anionic surfactant;

(c) about 1 wt. % to about 50 wt. % of a cosurfactant, wherein said cosurfactant is selected from the group consisting of $C_3$ to $C_9$ alkanols, isoalkanol or cycloalkanols, propylene glycols of the formula $HO(CH_3CHCH_2O)_mH$, wherein m is from 2 to 18, and monoalkyl ethers and esters of ethylene glycol or propylene glycol having the structured formulas $R(X)_nOH$ or $R_1(X)_nOH$ wherein R is a $C_1$–$C_6$ alkyl, $R_1$ is a $C_2$–$C_4$ acyl group, X is $(OCH_2CH_2)$ or $(OCH_2(CH_3)CH)$ and n is from 1 to 4 and mixtures thereof;

(d) about 0.4 wt. % to about 20 wt. % of at least one hydrocarbon; and (e) the balance being water.

2. The composition of claim 1 which further contains a salt of a multivalent metal cation in an amount sufficient to provide from 0.5 to 1.5 equivalents of said cation per equivalent of said artionic surfactant.

3. The composition of claim 2, wherein said composition contains 0.9 to 1.2 equivalents of said multivalent metal cation per equivalent of said anionic surfactant.

4. The composition of claim 2 wherein the multivalent metal cation is magnesium or aluminum.

5. The composition of claim 4 wherein said salt of said multivalent metal cation is magnesium oxide or magnesium sulfate.

* * * * *